US007377141B2

(12) United States Patent
Javaux et al.

(10) Patent No.: US 7,377,141 B2
(45) Date of Patent: May 27, 2008

(54) DEVICE FOR LOCKING AND UNLOCKING A COVER OR LID ON A FRAME BY MEANS OF A KEY

(75) Inventors: Philippe Javaux, Cuxac d'Aude (FR); Jean-Jacques Monneret, Lyons (FR)

(73) Assignee: Norinco, Saint Crepin Ibouvillers (FR)

( * ) Notice: Subject to any disclaimer, the term of this patent is extended or adjusted under 35 U.S.C. 154(b) by 0 days.

(21) Appl. No.: 11/191,652

(22) Filed: Jul. 28, 2005

(65) Prior Publication Data

US 2006/0021396 A1 Feb. 2, 2006

(30) Foreign Application Priority Data

Jul. 30, 2004 (FR) ..... 04 08462

(51) Int. Cl.
*B65D 55/14* (2006.01)
*E05C 19/10* (2006.01)

(52) U.S. Cl. ..... 70/168; 70/167; 292/99; 292/DIG. 11

(58) Field of Classification Search ..... 70/166–168, 70/159, 389, 399, 403, 409, 89, 90, 78–80, 70/158, 169, 160–163; 292/195, 197, 200, 292/202, 210, 304, DIG. 11, 341.15, 341.17, 292/99

See application file for complete search history.

(56) References Cited

U.S. PATENT DOCUMENTS 887,591 A * 5/1908 Cook ..... 137/371
1,239,704 A * 9/1917 Lee et al. ..... 220/259.3
1,342,563 A * 6/1920 More ..... 292/240
1,442,446 A * 1/1923 Rynearson ..... 70/168
1,725,908 A * 8/1929 Gerneth et al. ..... 70/168
2,594,012 A * 4/1952 Griffin ..... 220/323
5,056,955 A * 10/1991 Spiess et al. ..... 404/25
5,556,141 A * 9/1996 Rogers ..... 292/99
6,182,482 B1 2/2001 Issitt

FOREIGN PATENT DOCUMENTS

DE 297 21 996 4/1999
EP 0808951 11/1997

* cited by examiner

*Primary Examiner*—Patricia Engle
*Assistant Examiner*—Alyson Merlino
(74) *Attorney, Agent, or Firm*—Ladas & Parry LLP

(57) ABSTRACT

A device for locking and unlocking a cover or lid on a frame by means of a key. The device includes an element forming the locking bolt formed of an elastically deformable rod protruding from the cover and terminating in a hook-shaped free end suitable for engaging under a rigid rib of the receiver of the frame. The key has a spur making it possible to elastically move the rod to disengage its hook-shaped end from the rigid rib.

11 Claims, 3 Drawing Sheets

7
3
6
8
16
8a
14
10
10a
10b
10b1
9
12
12a
4
15
VII
1
1a
11
2c
5
17
13
2a
2
2b

DEVICE FOR LOCKING AND UNLOCKING A COVER OR LID ON A FRAME BY MEANS OF A KEY

BACKGROUND OF THE INVENTION

The invention relates to a device for locking and unlocking a cover or lid on a frame by means of a key.

It can be applied to roadway equipment such as a manhole.

Already known in the art is such a device that comprises a lock integral with the cover having an access opening in the lock for the key. This key comprises an arm having at its end a socket-forming part allowing the lock to be operated, when the key is inserted into the opening of the cover, from a locked position in which a locking bolt is held confined in a locking bolt receiver of the frame to an unlocked position for which the locking bolt is released from the receiver and the key is held confined in the opening of the cover. The lock also comprises a rotor mounted in rotation in the cover and accessible through the opening of the cover, the rotor being coupled to the locking bolt perpendicular to said bolt. When the key is inserted into the cover with the cover in the locked position on the frame and is operated to unlock the cover from the frame, the assembly composed of the rotor and the locking bolt pivots from its position confined in the receiver to its position released therefrom.

This known device has the disadvantages of using rather large number of components, making it relatively complex and resulting in risks of clogging, which could alter the operation of this device.

SUMMARY OF THE INVENTION

A purpose of the present invention is to eliminate the above-mentioned disadvantages by proposing a device for locking and unlocking a cover or lid on a frame by means of a key, comprising a lock whose element forming the locking bolt receiver is integral with the frame and the element forming the locking bolt is integral with the cover which has an opening for access of the key to the element forming the locking bolt, which key comprises an arm having at one of its ends a spur-shaped operating device allowing the element forming the locking bolt to be operated, when the key is inserted in the opening of the cover, from a locked position in which the element forming the locking bolt is held confined in the locking bolt receiver to an unlocked position for which the element forming the locking bolt is released from the locking bolt receiver and the key is held confined in the opening of the cover, and which is characterized in that the element forming the locking bolt comprises an elastically deformable rod protruding beneath the cover appreciably perpendicular to said cover and terminating in a hook-shaped free end suitable for engaging under a rib or rigid tab of the frame. The key has its spur-shaped operating device making it possible to elastically move the rod to disengage its hook-shaped end from the rib or rigid tab when the key is inserted in the opening of the cover and turned from a specific angle around the longitudinal axis of the arm of the key so as to unlock the cover.

The device comprises a means of positioning the key relative to the rib or tab of the locking bolt receiver when inserted into the opening of the cover to allow the spur of the key to be positioned in a space between the cover and the rib or tab, and in which the spur can pivot freely until it comes in contact with the rod of the element forming the locking bolt in order to elastically move it away from the rib or tab and be immobilized in rotation by the elastic return force exerted by the rod of the element forming the locking bolt to a position beneath the cover in which the spur axially retains the key relative to the cover so as to confine the key in the cover.

Advantageously the spur of the key has an internal concavity at its free end in which the rod of the locking bolt forming element is held in its position separated from the rib or tab when the key is in its position of unlocking the cover.

The arm of the key includes at its end a second spur opposite the operating spur of the rod of the locking bolt forming element and cooperating with the operating spur in order to occupy a position holding the key in the cover transverse to the opening thereof when the key is in the unlocking position.

Preferably, the means of positioning the key relative to the rib or tab of the receiver comprises a hole made in the rib or tab directly below the opening of the cover and suitable for receiving the cylindrical free end of the arm of the key so that at least the operating spur extending transversely to the arm above its cylindrical end can be supported on the rib or tab.

The element forming the locking bolt also comprises an appreciably U-shaped part housed in the cover parallel to the outer face thereof and one of the arms of which includes at its end the rod of the locking bolt extending perpendicularly to the plane of the U-shaped part, the two arms of which are symmetrical to the longitudinal median plane of the cover opening, these two arms being separated from each other by a distance greater than that of the opening of the cover.

At least one of the arms of the U-shaped part of the element forming the locking bolt comprises a means, appreciably in the middle of said part, of holding the part in its housing of the cover.

Preferably, the holding means is composed of an arc-shaped deformation in the arm of the U-shaped part defining an outer concavity opposite to the other arm and in which a conjugate lobe of the wall of the housing in the cover snaps in place, which lobe is situated opposite the deformed arm of the U-shaped part.

The operating spur of the arm of the key has a length that is greater than that of the second spur of this arm.

The opening of the cover has a transverse cross section which creates a foolproof shape.

The rib or tab of the locking bolt receiver is integral with one of the side walls of the frame and extends parallel to the upper edge of the frame that supports the cover.

The key is turned about one quarter turn to unlock the cover.

BRIEF DESCRIPTION OF THE DRAWING FIGURES

The invention will be better understood, and other purposes, characteristics, details and advantages thereof will appear more clearly from the following explanatory description with reference to the attached diagrammatic drawings, provided solely by way of example illustrating one form of embodiment of the invention, and in which.

DETAILED DESCRIPTION OF THE PREFERRED EMBODIMENTS

Figure 1:
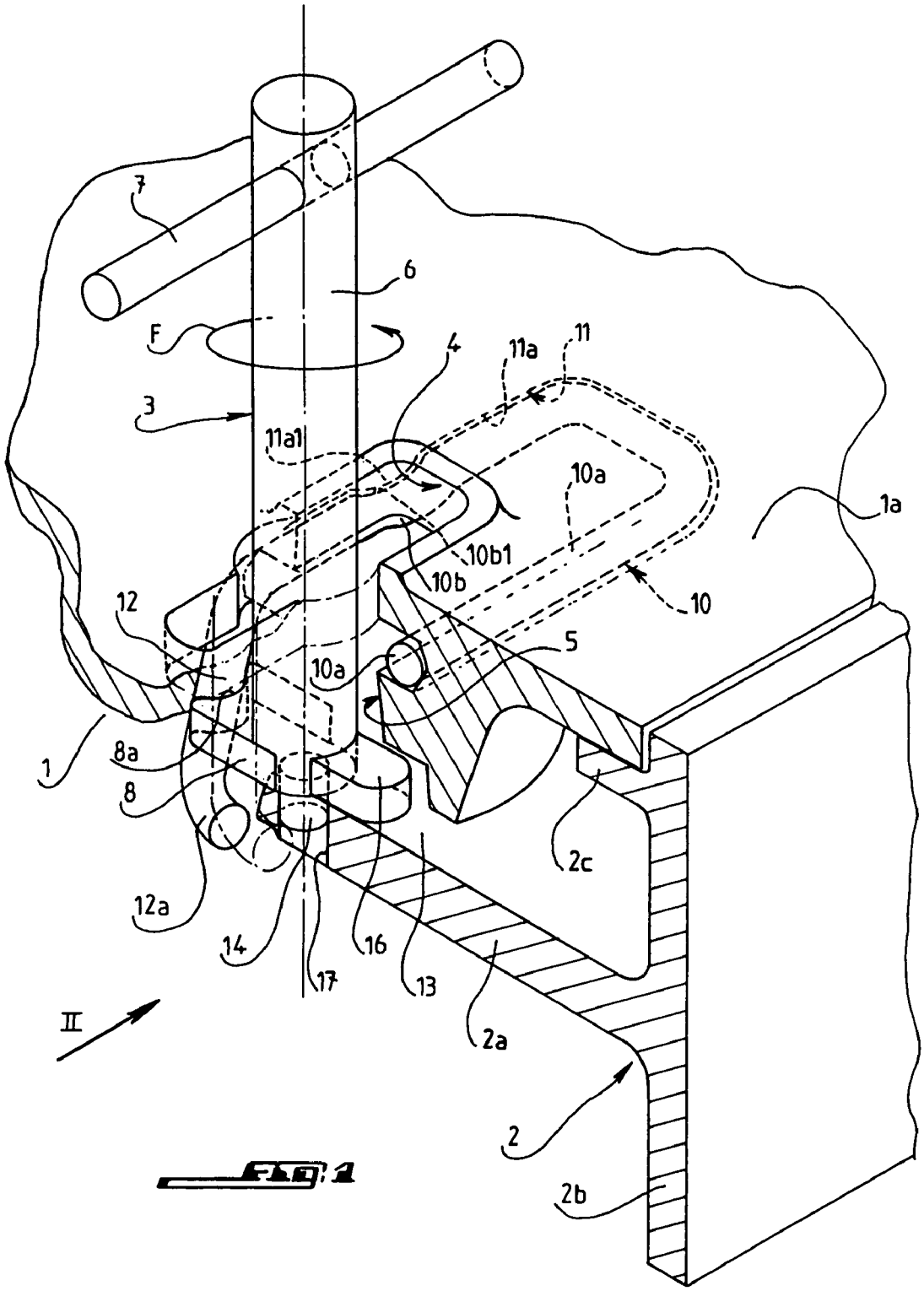
FIG. 1 is a cutaway view in perspective of a device for locking and unlocking a cover on a frame according to the invention.

The locking device of the invention that will now be described is particularly intended to equip a cover, lid or similar 1 to enable a frame, underframe or similar 2 to be closed, and delimiting, for example, the opening of a manhole.

The locking device is operable by a key 3.

The upper wall 1*a* of the cover 1 includes an access opening 4 for the key 3 and which opens from one side into the inside of the cover 1 and from the other side into a cavity 5 which in turn opens into the frame in the position of the cover 1 locked to the frame 2.

The key 3 includes an elongated cylindrical arm 6 one end of which includes an operating handle 7 composed of a transverse bar extending on either side of the arm 6 and the opposite end includes a device 8 that operates the element that forms the locking bolt 9 of a lock when the key 3 is inserted into the opening 4 of the cover from a locking position in which the element that forms the locking bolt 9 is held confined in a locking bolt receiver 2*a* of the lock integral with the frame 2 to an unlocking position for which the element that forms the locking bolt 9 is released from said receiver 2*a* and the key 3 is held confined in the opening 4 of the cover 1.

According to the invention, the element that forms the locking bolt 9 of the lock comprises an appreciably U-shaped part 10 housed in a conjugate cavity 11 of the cover 1 while extending appreciably parallel to the plane of the outer face of the upper wall of the cover 1 and a rod 12 integral with the end of one of the arms 10*a* of the part 10 while extending perpendicular from the plane passing through these arms, the rod of the locking bolt 12 terminating in an end curved into a hook 12*a*. Preferably, the part 10 and the rod 12 have a cross section that is circular in shape.

Figures 4, 5, 6, 7:
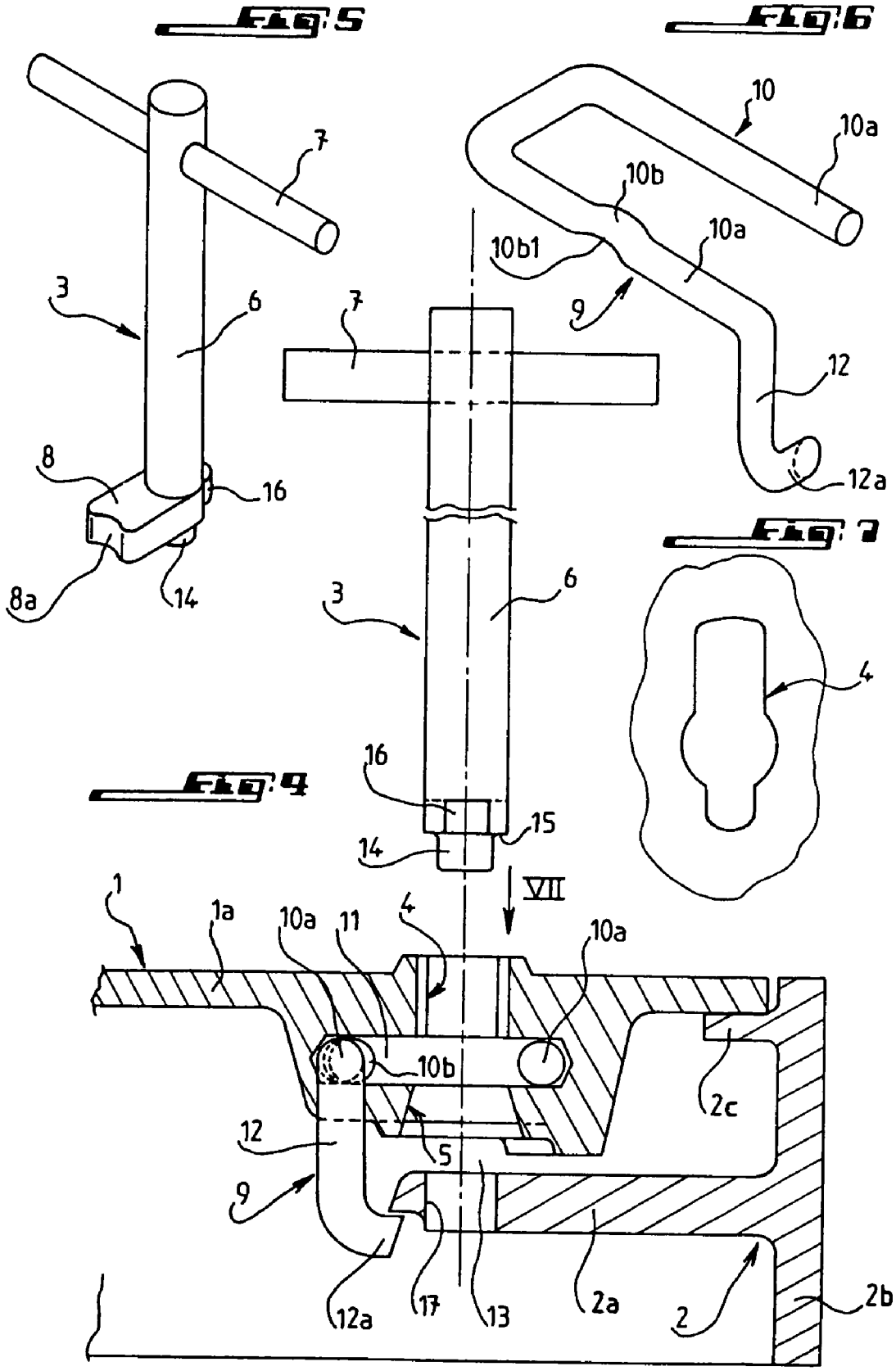
FIG. 4 is a view similar to that of FIG. 3 and representing the insertion of the key in the cover to unlock it from its support frame.
FIG. 5 is a view in perspective of the unlocking key comprising part of the device of the invention.
FIG. 6 is a view in perspective of the locking bolt forming element of the device of the invention.
FIG. 7 is a top view along the arrow VII of FIG. 4 of the opening of the cover allowing the key to access the lock of said cover.

When the element that forms the locking bolt 9 is secured in the cavity 11 of the cover 1, the rod 12 protrudes from the cover 1 in the opposite direction of its outer face and perpendicular to said outer face so that in the closed position of the cover 1 on the frame 2, the hooked end 12*a* of the rod 12 is engaged under a rigid rib constituting the locking bolt receiver 2*a* of the lock integral with one of the side walls 2*b* of the frame 2 perpendicularly to said frame, as can best be seen in FIG. 4. The rib 2*a* is situated at a certain distance below a peripheral edge 2*c* of the frame 2 on which the cover 1 is supported and which is held locked there by the end 12*a* of the rod 12 anchored to the rib 2*a*. When the cover 1 is in the position locked to the frame 2, the cover 1 leaves a space 13 with the rib 2*a*.

The U-shaped part 10 of the locking bolt 9 is held in the cavity 11 of the cover 1 by a holding means situated approximately in the middle of one of the arms 10*a* of the part 10, and composed in this instance of an arc-shaped deformation 10*b* of this arm defining a concavity 10*b*1 directed outward and opposite to the other arm 10*a*, and in which a conjugate lobe 11*a*1 of the wall 11*a* of the cavity 11 housing the part 10 is engaged by being snapped in place by elastic deformation of one of the two arms 10*a*, the wall 11*a* being situated facing the deformed arm 10*a* of the part 10. When appropriate, the part 10 can be removed from the cavity 11 by elastically moving the two arms 10*a* toward each other by means of a suitable tool and pulling on said arms. As a variation, the part 10 can also be held in the cavity 11 by another deformation of the other arm 10*a* identical to the preceding one and in which is snapped a lobe identical to the lobe 11*a*1 of the wall of the cavity 11 opposite to the wall 11*a*.

The key's operating device 8 is spur-shaped, extending perpendicular to the arm 6 the free end of which opposite to the operating handle 7 defines a cylindrical end fitting 14 of smaller diameter than that of the cylindrical arm 6 of the key 3 so as to define a shoulder 15 which, in this instance, is the same as the lower face of the spur 8.

The arm 6 of the key 3 includes at its end opposite to the handle 7 a second spur 16 integral with the arm 6 and perpendicular thereto opposite the spur 8 and shorter than said spur 8. The lower face of the spur 8 is also in the same plane as the shoulder 15 of the arm 6.

As shown in FIG. 7, the opening 4 through which the key 3 passes has a cross sectional shape conjugate with the one defined by the two spurs 8, 16 situated on either side of the cylindrical arm 6 of the key 3, and this shape creates a foolproof means of insertion.

The two arms 10*a* of the part 10 housed in the cavity 11 are separated from each other by a distance that is greater than the widest part of the opening 4 and are situated symmetrically on each side of the longitudinal median plane of the opening 4. The cavity 11 is thus situated between the opening 4 and the cavity 5 that opens above the free end of the rib 2*a*.

The rib 2*a* includes at its inner free end at the frame 2 a hole 17 situated directly beneath the opening 4 of the cavity 5. The hole 17 is intended to receive the cylindrical end 14 of the arm 6 of the key 3.

Starting with the frame 2 being in the position closed by the cover 1, represented in particular in FIG. 4, the key 3 is inserted into the opening 4 and the cavity 5 until the end 14 engages in the hole 17 of the rib 2*a* and the shoulder 15, and consequently the spurs 8, 16, are in contact with the rib 2*a*, thus positioning the key 3 relative to the rib so that the two spurs 8, 16 are situated in the space 13 between the cover 1 and the rib 2*a*.

Figure 2:
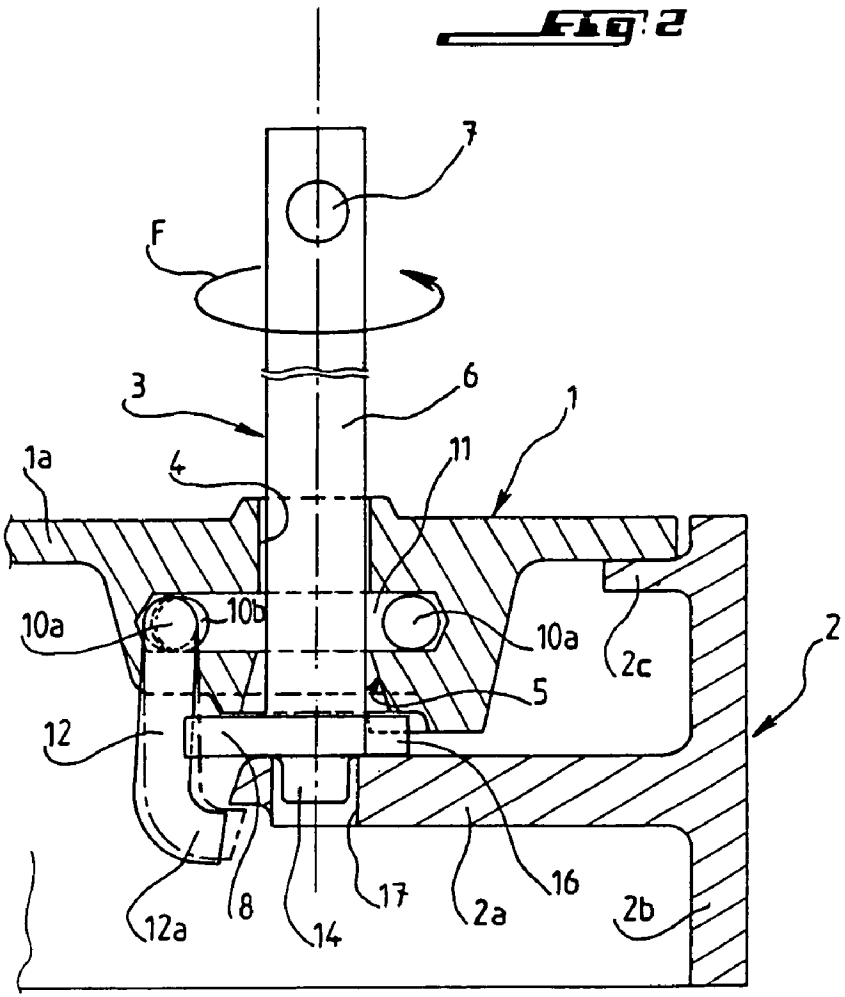
FIG. 2 is a view along the arrow II of the device of FIG. 1 and representing the cover in the position unlocked from its frame.
Figure 3:
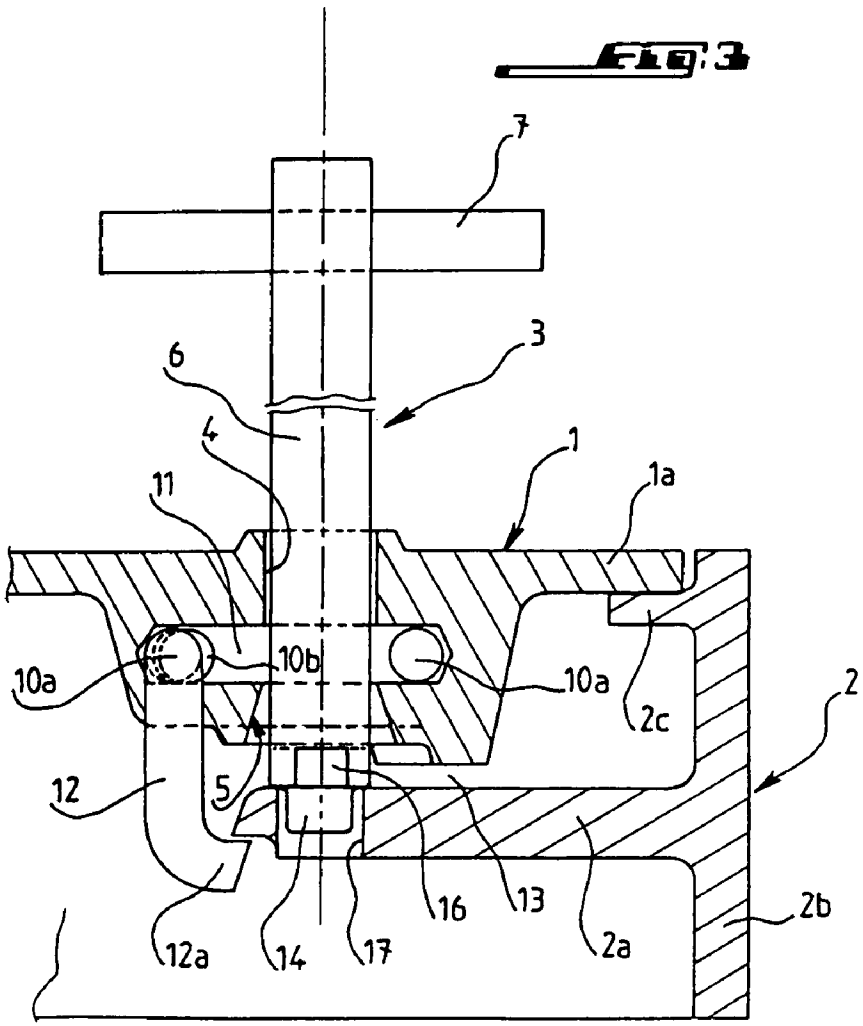
FIG. 3 is a view similar to that of FIG. 2 and representing the cover in the position locked on the frame.

By turning the key 3 about a quarter turn around its longitudinal axis in the direction indicated by the arrow F in FIG. 1 and FIG. 2, the spur 8 is moved in the space 13 until it comes in contact with the rod 12 which is then elastically moved away from the side wall 2*b* of the frame 2 including the rib 2*a* so as to disengage the hook 12*a* from under the free end of the rib 2*a*, thus releasing the element forming the locking bolt 9 from the locking bolt receiver 2*a*. The spur 8 has an internal concavity 8*a* at its free end, in which concavity the rod 12 is held in its position separated from the rib as represented in FIG. 1 and FIG. 2, and the elastic return force exerted by the rod 12 on the spur 8 makes it possible to immobilize it in rotation at a position such that the two spurs 8 and 16 extend transversely to the longitudinal axis of the cavity 4 under the cover 1 so as to prevent the axial withdrawal of the key 3 from this cover. In other words, in the unlocked position of the cover 1 from the frame 2, the key remains confined in the cover 1. The operator can then remove the cover 1 by lifting it with the key 3.

To lock the cover 1 again on to the frame 2, the key 3 is simply turned in the direction opposite to the arrow F to disengage the spur 8 from the rod 12 which elastically returns to its position in which the hook 12*a* becomes immobilized under the rib 2*a*. Then, when the two spurs 8 and 16 are in their position in alignment below the opening 4, the key can be axially removed from the cover 1.

Obviously, various modifications can be made to the device described above without going beyond the scope of the invention. Thus, the rib 2*a* can be replaced by a rigid tab integral with the inner face of the corresponding side wall 2*b* of the frame 2.

The device according to the invention has a very simplified structure in comparison to devices known up until now for locking and unlocking manhole covers, and consequently uses fewer elements than said known devices. Moreover, the shapes of the opening 4 and cavities 5 and 11 and the positioning of the element forming the locking bolt 9 in the cover 1 as well as the simple rod form of this element for locking the cover to the frame, eliminate any risk of jamming of these parts that could hinder the proper operation of the locking device. Finally, the design of this device is such that it requires a special locking and unlocking key, precluding the use of common keys.

The invention claimed is:

1. Device for locking and unlocking a cover or lid on a frame by means of a key, comprising:

a lock whose element forming the locking bolt receiver is integral with the frame, and the element forming the locking bolt is integral with the cover which has an opening for access of the key to the element forming the locking bolt, which key comprises an arm having a spur-shaped operating device disposed at one end of the arm allowing the element forming the locking bolt to be operated, when the key is inserted in the opening of the cover, from a locked position in which the element forming the locking bolt is held confined in the locking bolt receiver to an unlocked position for which the element forming the locking bolt is released from the locking bolt receiver and the key is held confined in the opening of the cover;

wherein the element forming the locking bolt comprises an elastically deformable rod protruding beneath the cover appreciably perpendicular to said cover and terminating in a hook-shaped free end suitable for engaging under a rib or rigid tab of the receiver of the frame to lock the cover to the frame;

wherein the spur-shaped operating device permits elastic movement of the rod to disengage the hook-shaped end from the rib or rigid tab when the key is inserted in the opening of the cover and turned from a specific angle around the longitudinal axis of the arm of the key so as to unlock the cover; and wherein the spur-shaped operating device of the key has an internal concavity at a free end in which the rod of the locking bolt is held in position separated from the rib or tab when the key is in a position of unlocking the cover.

2. Device according to claim 1, further comprising a means of positioning the key relative to the rib or tab of the locking bolt receiver when inserted into the opening of the cover to allow the spur-shaped operating device of the key to be positioned in a space between the cover and the rib or tab, and in which the spur-shaped operating device can pivot freely until coming in contact with the rod of the locking bolt in order to elastically move the spur-shaped operating device away from the rib or tab and be immobilized in rotation by the elastic return force exerted by the rod of the locking bolt to a position beneath the cover in which the spur-shaped operating device axially retains the key relative to the cover so as to confine the key in the cover.

3. Device according to claim 2, wherein the arm of the key includes a second spur at an end opposite the spur-shaped operating device of the rod of the locking bolt and cooperating with the spur-shaped operating device in order to occupy a position holding the key in the cover transverse to the opening thereof when the key is in the unlocking position.

4. Device according to claim 2, wherein the means of positioning the key relative to the rib or tab of the receiver comprises a hole made in the rib or tab directly below the opening of the cover and suitable for receiving a cylindrical free end of the arm of the key so that at least the operating spur extending transversely to the arm above its cylindrical end can be supported on the rib or tab.

5. Device according to claim 1, wherein the element forming the locking bolt also comprises an appreciably U-shaped part housed in the cover parallel to the outer face thereof and at the end of one of the arms the rod of the locking bolt extending perpendicularly to the plane of the U-shaped part, the two arms of which are symmetrical to a longitudinal median plane of the opening of the cover, these two arms being separated from each other by a distance greater than that of the opening of the cover.

6. Device according to claim 5, wherein at least one of the arms of the U-shaped part of the element forming the locking bolt comprises a means, appreciably in the middle of said part, of holding the part in a housing of the cover.

7. Device according to claim 6, wherein the holding means is composed of an arc-shaped deformation in the arm of the U-shaped part defining an outer concavity opposite to the other arm and in which a conjugate lobe of the wall of the housing in the cover snaps in place, which lobe is situated opposite the deformed arm of the U-shaped part.

8. Device according to claim 3, wherein the spur-shaped operating device of the arm of the key has a length that is greater than that of the second spur of this arm.

9. Device according to claim 1, wherein the opening of the cover has a transverse cross section which creates a foolproof shape.

10. Device according to claim 1, wherein the rib or tab of the locking bolt receiver is integral with one of the side walls of the frame and extends parallel to an upper edge of the frame that supports the cover.

11. Device according to claim 1, wherein the key is turned about one quarter turn to unlock the cover.

* * * * *